US006681977B1

(12) United States Patent
Matlock

(10) Patent No.: US 6,681,977 B1
(45) Date of Patent: Jan. 27, 2004

(54) WOOD TIE END PLATING MACHINE

(75) Inventor: Gordon E. Matlock, Bourbon, MO (US)

(73) Assignee: Robbins Manufacturing Company, Tampa, FL (US)

( * ) Notice: Subject to any disclaimer, the term of this patent is extended or adjusted under 35 U.S.C. 154(b) by 73 days.

(21) Appl. No.: 10/125,104

(22) Filed: Apr. 17, 2002

(51) Int. Cl.[7] ..... B27F 7/15
(52) U.S. Cl. ..... 227/152; 227/39; 227/100
(58) Field of Search ..... 227/39, 44, 100, 227/150, 151, 152, 113; 269/156, 239, 902

(56) References Cited

U.S. PATENT DOCUMENTS 4,373,652 A * 2/1983 Matlock et al. ..... 227/100
4,504,006 A * 3/1985 Lollar, Sr. ..... 227/152
4,513,900 A 4/1985 Matlock
4,657,168 A 4/1987 Matlock
5,110,028 A * 5/1992 Matlock ..... 227/39
5,168,627 A * 12/1992 Owen ..... 29/897.34
5,392,908 A * 2/1995 Black, Jr. ..... 206/321
5,927,586 A 7/1999 Matlock
6,006,976 A 12/1999 Matlock
6,024,270 A 2/2000 Matlock

* cited by examiner

*Primary Examiner*—Scott A. Smith
*Assistant Examiner*—Chukwurah Nathaniel

(57) ABSTRACT

An end plating machine for a wood tie having opposite ends comprising a frame including horizontally spaced-apart first and second end frames with the frame including tie in-feed and out-feed portions. First and second tie dampers are positioned adjacent the first and second end frames for clamping the ends of a tie positioned therebetween. First and second power rams are mounted on the first and second end frames, respectively, for driving an end plate into the ends of the tie while the tie is being clamped by the first and second tie clampers. First and second end plate hoppers are positioned on the first end frame and third and fourth end plates hoppers are positioned on the second end frame. A movable shuttle plate is provided on each of the end frames as is a plate transporter.

16 Claims, 12 Drawing Sheets

WOOD TIE END PLATING MACHINE

BACKGROUND OF THE INVENTION

1. Field of the Invention

This invention relates to an end plating machine for a wood tie and more particularly to a machine for end plating a wood tie wherein the opposite ends of the tie are simultaneously end plated in an automatic fashion without the need of the end plates being initially hand-tacked onto the ends of the tie. More particularly, this invention relates to an improvement of the end plating machine disclosed in U.S. Pat. No. 5,927,586.

2. Description of the Related Art

Cross ties and switch ties for use in the railroad industry are normally formed from green wood and frequently develop splits in the ends thereof during the seasoning process. It has been found desirable and necessary to close the splits or cracks in the ends of the tie and to maintain the same in that condition by means of nail plates, dowels, S-irons, etc., to extend the useful life of the tie. Many prior art devices have been provided for squeezing or clamping the ends of a tie together and then driving a nail plate or end plate into the ends thereof. For example, see U.S. Pat. Nos. 4,513,900 and 4,657,168. In the prior art plating machines identified hereinbefore, the ties are fed into the end plating machine with the end plates being initially partially hand-tacked onto the ends of the tie to maintain the end plates in position until the ends of the tie have been squeezed or clamped and the power ram has driven the end plates into the ends of the tie. The requirement that the end plates be initially partially hand-tacked onto the ends of the tie adds additional time and labor to the end plating process.

Applicant has previously received U.S. Pat. No. 5,927,586 which issued on Jul. 27, 1999, entitled "WOOD TIE END PLATING MACHINE". The end plating machine of the '586 patent includes a pair of spaced-apart end frames with the end frames including clamping means and power rams. A pair of end plate hoppers or stations are provided on each of the end frames with the machine having the ability to automatically end plate ties having different dimensions. The end plates are arranged in the end plate stations in a vertically stacked condition with the machine being able to transfer end plates from the hoppers, or stations, to the ends of the tie through a plate transporter assembly positioned in each of the end frames. Applicant also received U.S. Pat. Nos. 6,006,976 and 6,024,270 which are divisions of U.S. Pat. No. 5,927,586. Although the end plating machine of the '586 patent works extremely well and has met with commercial success, the instant invention represents an improvement over the '586 end plating machine in that the present invention is faster and more precise than the machine of the '586 patent and requires less moving parts. Further, the instant invention enables the end plating of three different dimensioned ties with two different dimensioned end plates.

SUMMARY OF THE INVENTION

An end plating machine for a wood tie comprising a frame including horizontally spaced-apart first and second end frames with the frame having tie in-feed and out-feed portions. A first tie damper or squeezer is provided adjacent one of the end frames for clamping or squeezing one end of the tie positioned between the end frames. A second tie damper or squeezer is positioned adjacent the second end frame for clamping or squeezing the other end of the tie positioned between the end frames. A first power ram is mounted on the first end frame for driving an end plate into one end of the tie while the first tie damper is clamping the end of the tie positioned therein. A second power ram is mounted on the second end frame for driving an end plate into the other end of the tie while the second tie damper is clamping the other end of the tie positioned therein. First and second end plate hoppers or stations are mounted on the first end frame for supporting a plurality of end plates therein in a stacked condition. Third and fourth end plates hoppers or stations are mounted on the second end frame for supporting a plurality of end plates therein in a stacked condition. The end plates in the first and third end plate hoppers have the same dimension while the end plates in the second and fourth end plate hoppers have the same dimension with that dimension being different than the dimension of the end plates in the first and third end plate hoppers. First and second shuttle plate assemblies are movably mounted in the first and second end frames, respectively, with each of the assemblies including a magnetic shuttle plate which is selectively horizontally movable beneath the associated end plate hoppers for receiving an end plate thereon from one of the hoppers positioned thereabove. The magnetic shuttle plates may be pivotally moved from a horizontally disposed position to a vertically disposed position. Further, when the magnetic shuttle plates are in their vertically disposed condition, means is provided for horizontally moving the vertically disposed magnetic shuttle plate a small amount.

A plate transporter assembly is movably mounted in each of the end frames for transporting an end plate positioned on the magnetic shuttle plate, when the magnetic shuttle plate is in its vertically disposed position, to a position adjacent the associated power ram so that the power ram may drive the end plate into the end of the tie.

It is therefore a principle object of the invention to provide an improved end plating machine for a wood tie.

Yet another object of the invention is to provide an improved end plating machine for a wood tie which senses different sizes of ties and which automatically supplies properly dimensioned end plates to the power rams for insertion into the ends of the tie.

Yet another object of the invention is to provide an end plating machine having an improved shuttle plate assembly.

Yet another object of the invention is to provide an end plating machine for a wood tie including a pair of shuttle plate assemblies which are more precise and faster than prior art machines and which require less moving parts.

These and other objects will be obvious to those skilled in the art.

DESCRIPTION OF THE PREFERRED EMBODIMENT

Figure 1:
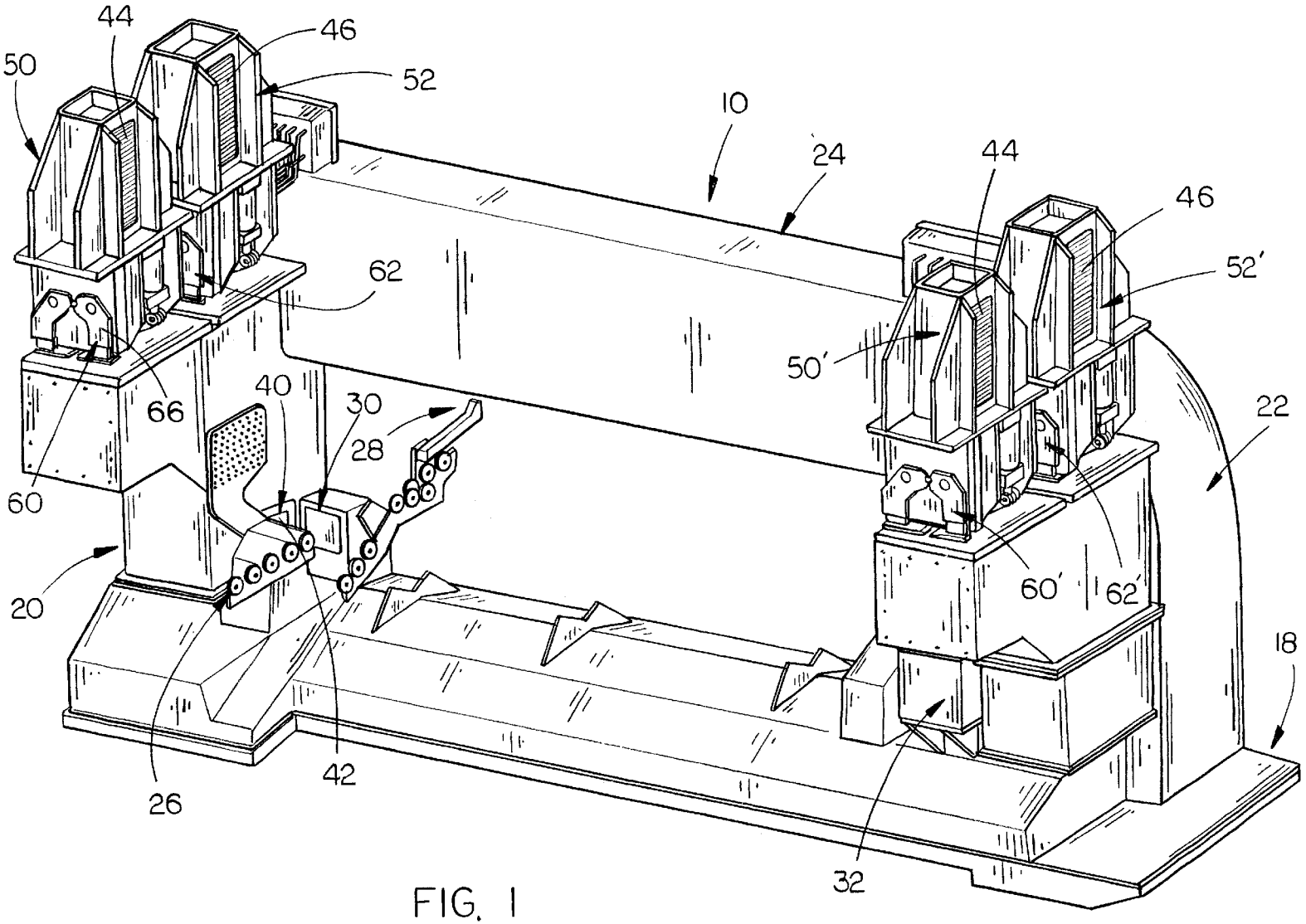
FIG. 1 is a perspective view of the end plating machine of this invention as viewed from the out-feed side thereof.

The end plating machine of this invention is referred to generally by the reference number 10 while the reference number 12 refers to an elongated wood tie which is to be end plated. The end plating machine of this invention incorporates a vast amount of the structure and technology of the end plating machine of U.S. Pat. No. 5,927,586. For purposes of discussion, tie 12 will be described as having opposite ends. Generally speaking, machine 10 includes a frame means 18 including end frames 20 and 22 which have a supporting structure 24 extending therebetween. The numeral 28 designates an in-feed conveyor for positioning the tie 12, and successive ties, between the end frames 20 and 22 in a manner such as disclosed in U.S. Pat. No. 4,513,900. Machine 10 is also provided with an exit-feed conveyor 26 for moving the end plated tie out of the machine 10 and for conveying the tie away from the machine.

Machine 10 further includes a tie squeezing or clamping apparatus 30 adjacent the inner end of end frame 20 and a tie squeezing or clamping apparatus 32 adjacent the inner end of end frame 22 for squeezing or clamping the opposite ends of the tie 12 to close splits or cracks in the tie prior to the end plating operation. The tie clamping apparatuses 30 and 32 are preferably constructed similar to that disclosed in U.S. Pat. Nos. 4,513,900 or 4,657,168. Machine 10 also includes a pivotal tie sensing arm (not shown), generally similar to the tie sensing arm 34 of U.S. Pat. No. 5,927,586, which is pivoted by a hydraulic cylinder and which is adapted to engage the rearward end of the tie 12 to sense the thickness thereof as in U.S. Pat. No. 5,927,586.

Inasmuch as the structure on each of the end frames 20 and 22 is substantially identical, only the structure on end frame 20 will be described in detail with "'" indicating identical structure on end frame 22. A horizontally disposed power ram 40 is mounted on end frame 22 outwardly or laterally of the end of the tie 12 when it is positioned in the tie clamping apparatus 30. Ram 40 includes a magnetic head 42 for magnetically supporting a metal end plate thereon. For purposes of description, the numeral 44 will designate the smaller end plate handled by the machine 10 for smaller ties while the numeral 46 will designate the larger end plate for larger ties. Each of the end plates 44 and 46 includes a plurality of teeth 48 extending from one side thereof which are driven into the end of the tie as will be described in greater detail hereinafter.

Figure 4:
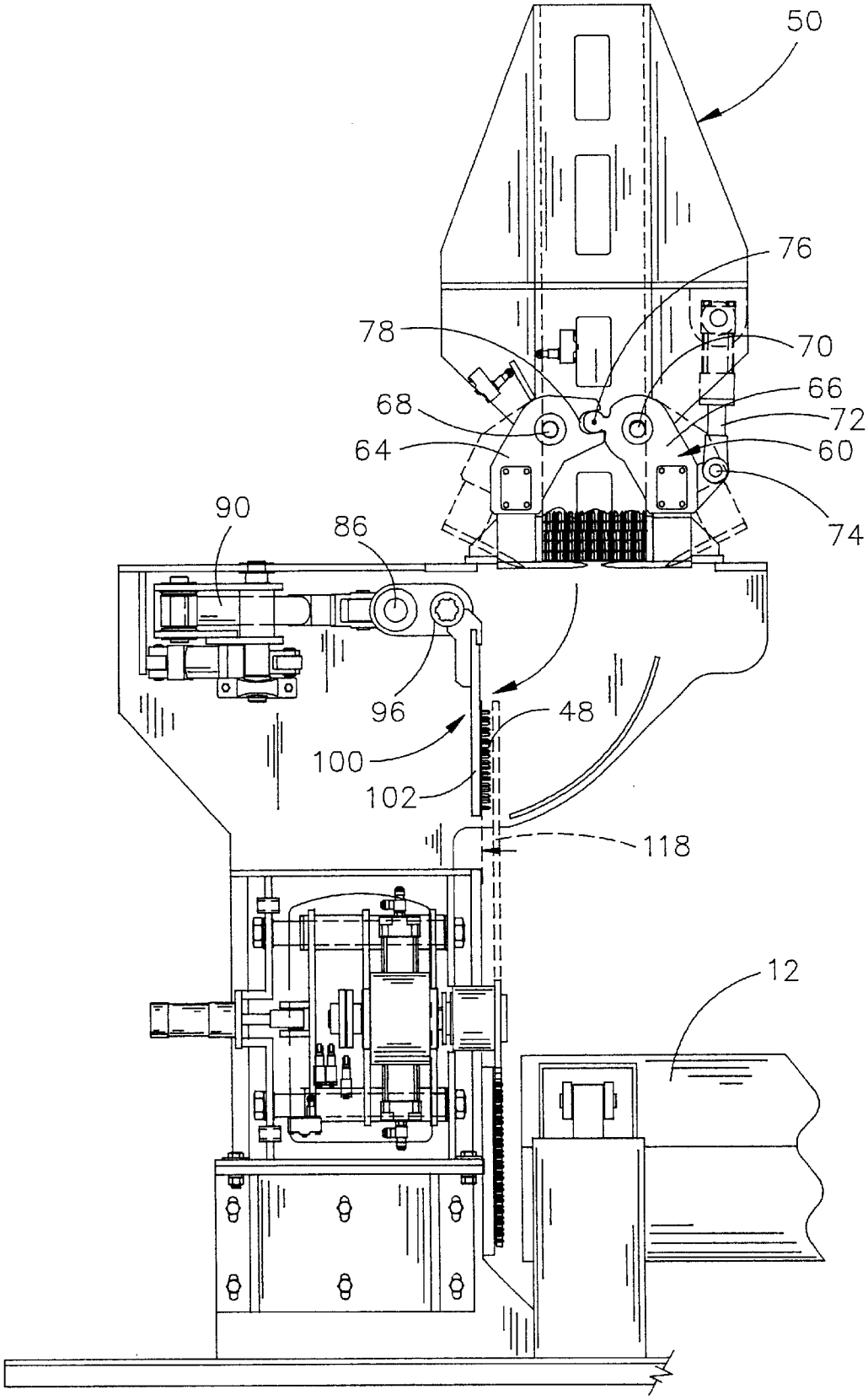
FIG. 4 is a view similar to FIG. 2 except that an end plate has been positioned on the shuttle plate.

A plurality of end plates 44 are stacked one upon the other in a horizontally disposed manner, with the teeth 48 thereof extending upwardly therefrom, in end plate hopper 50 mounted on end frame 20. Similarly, a plurality of end plates 46 are positioned in end plate hopper 52. The lower ends of hoppers 50 and 52 are open so as to be able to permit the passage of successive plates from the lower end thereof. Hoppers 50 and 52 are provided with hopper closure assemblies 60 and 62 while hoppers 50' and 52' are provided with hopper closure assemblies 60' and 62', respectively. Inasmuch as all of the hopper closure assemblies are identical, only assembly 60 will be described in detail with "'" identifying identical structure on the other hopper assemblies. Hopper closure assembly 60 includes a pair of arms 64 and 66 which are pivoted to the supporting structure of hopper 50 at 68 and 70, respectively. Arm 66 is pivotally connected to hydraulic cylinder 72 at 74 as seen in FIG. 4. Arm 66 is provided with a "knuckle" 76 which is movably received by opening 78 in arm 64 so that pivotal movement of arm 66 will cause pivotal movement of arm 64, as illustrated in the drawings. Arms 64 and 66 have a plurality of fingers 80 and 82 extending inwardly therefrom, respectively, which are designed to close the lower end of hopper 50 when in the position of FIG. 4 and to aid in separating the stack of end plates 44 in hopper 50 from the end plate being discharged from the lower end of hopper 50, as will be described in more detail hereinafter, and which is identical to that shown in U.S. Pat. No. 5,927,586.

Figure 3:
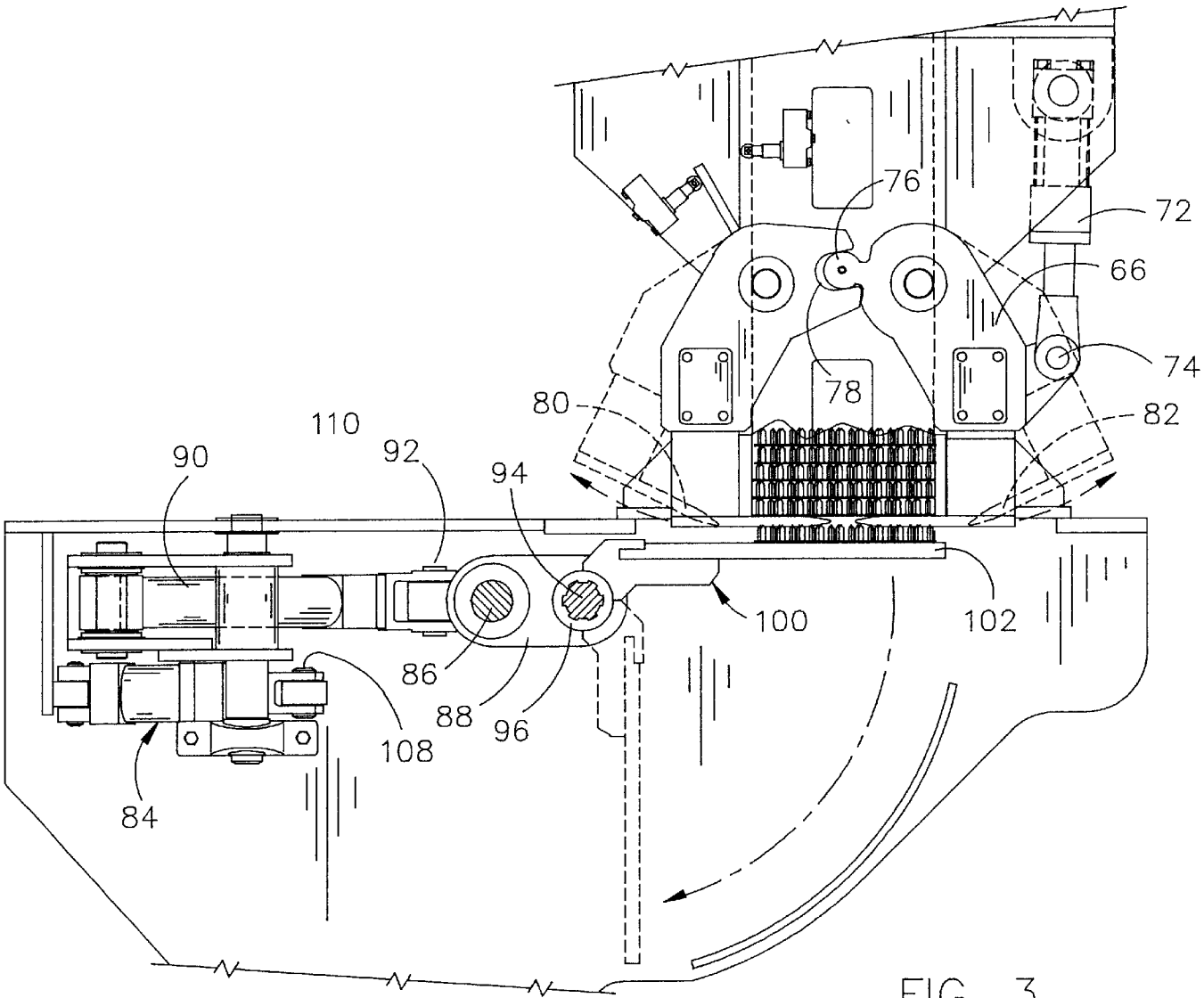
FIG. 3 is a partial view of the end frame of FIG. 2 illustrating the hopper closure means and the magnetic shuttle plate with the broken lines illustrating the hopper closure means in its open position and the magnetic shuttle plate in its vertically disposed position.
Figure 5:
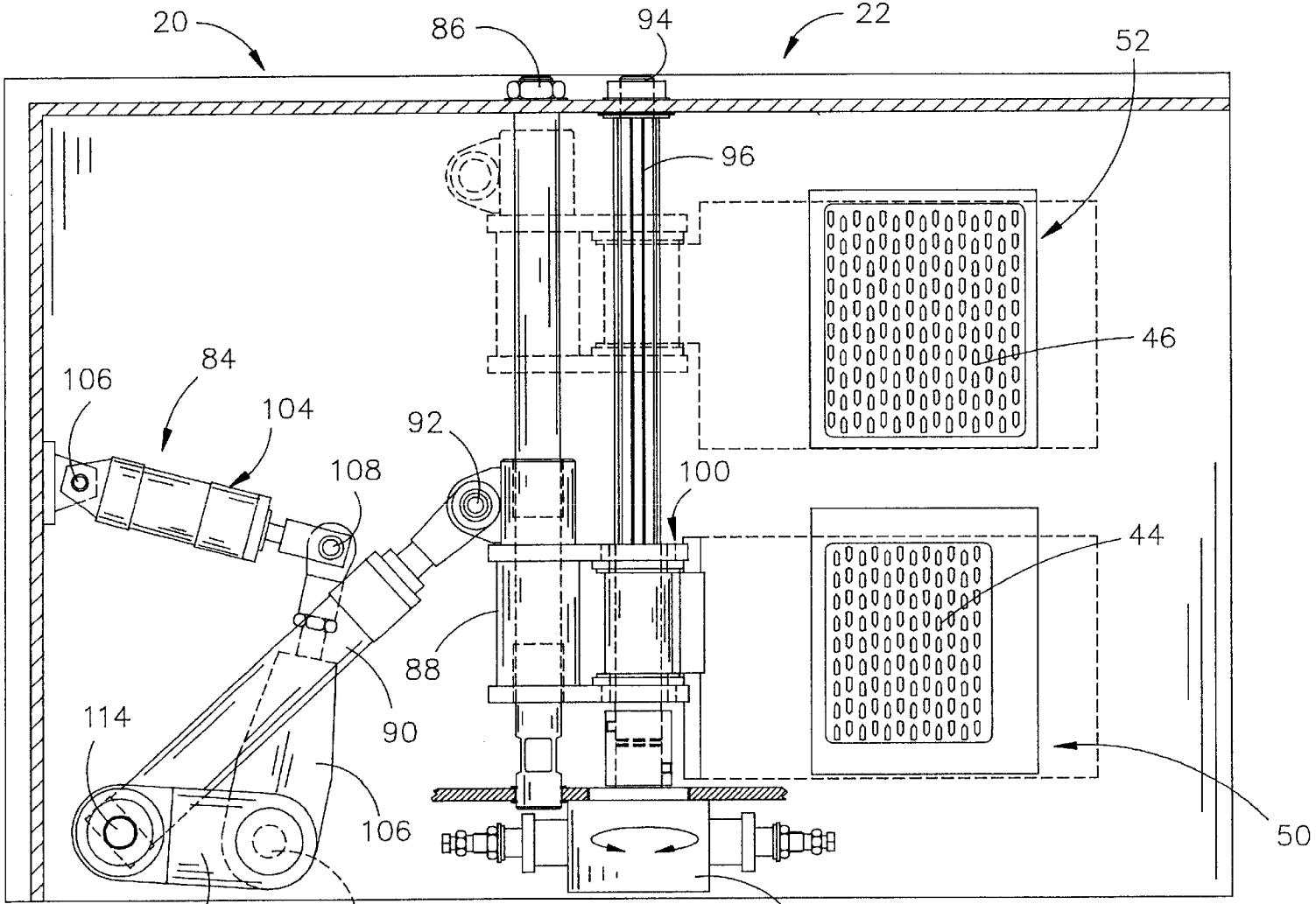
FIG. 5 is a horizontal sectional view showing the relationship of the plate hoppers and the magnetic shuttle plate.

The numeral 84 refers to a shuttle plate assembly which is mounted in end frame 20. An identical shuttle plate assembly is also mounted in end frame 22. The shuttle plate assembly 84 of this invention replaces the plate elevator assembly described and shown in U.S. Pat. No. 5,927,586. Shuttle plate assembly 84 includes a horizontally disposed, splined shaft 86 which is mounted in end frame 20 so as to be in a horizontally disposed position, as illustrated in FIG. 5. Support 88 is longitudinally slidably mounted on shaft 86 by means of power cylinder 90 which may be an air cylinder or a hydraulic cylinder. Cylinder 90 is pivotally connected to support 88 at 92. The numeral 94 refers to a horizontally disposed shaft which is mounted in end frame 20 adjacent shaft 86 and which is parallel thereto. Sleeve 96 is rotatably mounted on shaft 94 and is rotatable about its axis by means of a rotary actuator 98 operatively secured to one end thereof. Sleeve 96 rotatably extends through the outer end of support 88, as seen in FIG. 5. The numeral 100 refers to a shuttle plate including a magnetic plate portion 102. Shuttle plate 100 is affixed to the sleeve 96 so that rotation of sleeve 96 by the motor 98 causes the shuttle plate 100 to be pivotally moved from the horizontally disposed position, as seen in FIG. 3, to the vertically disposed position illustrated in FIG. 3 by broken lines and by solid lines in FIG. 4.

Figure 2:
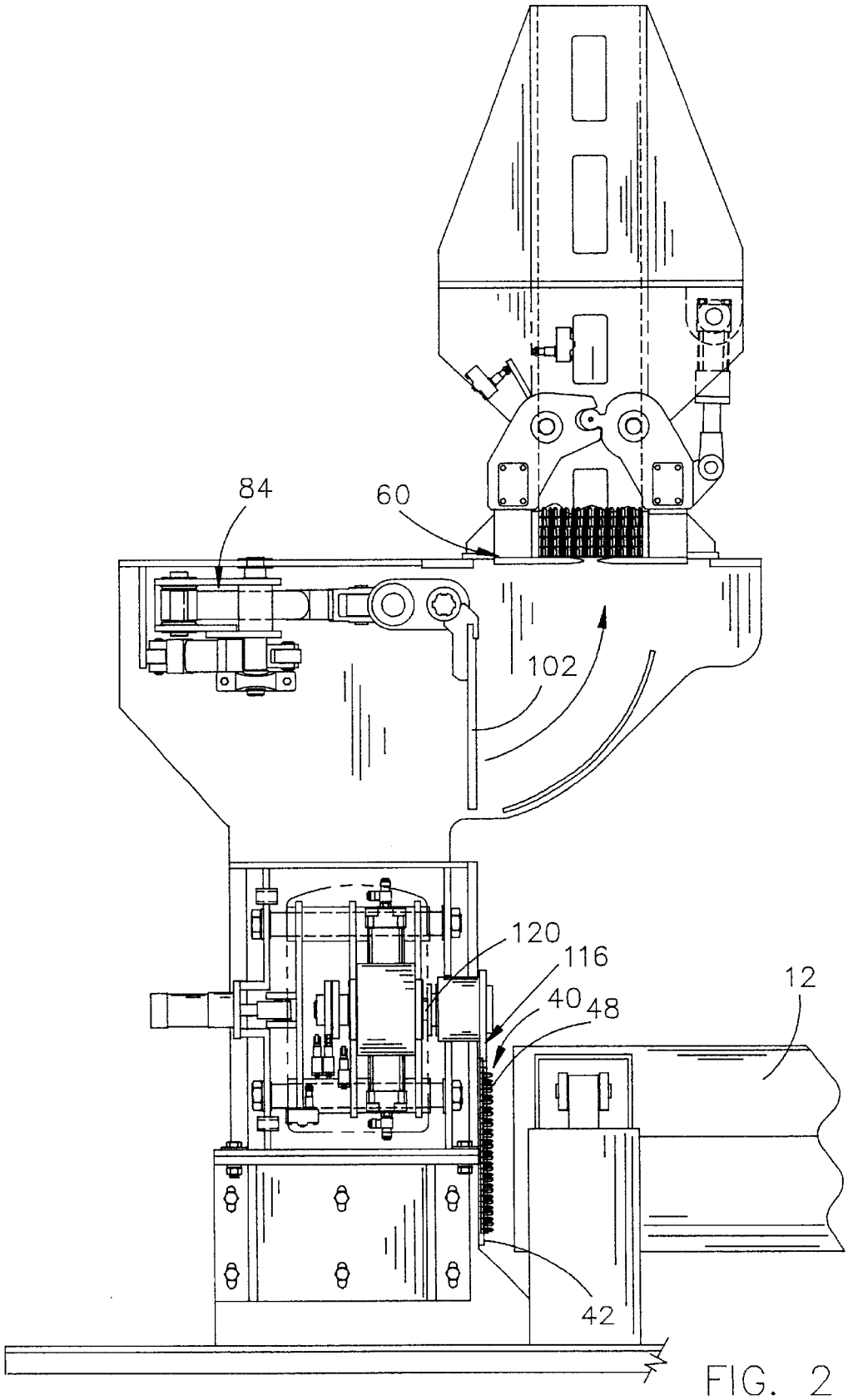
FIG. 2 is a partial vertical sectional view of one of the end frames, and associated structure, of the end plating machine.
Figure 6:
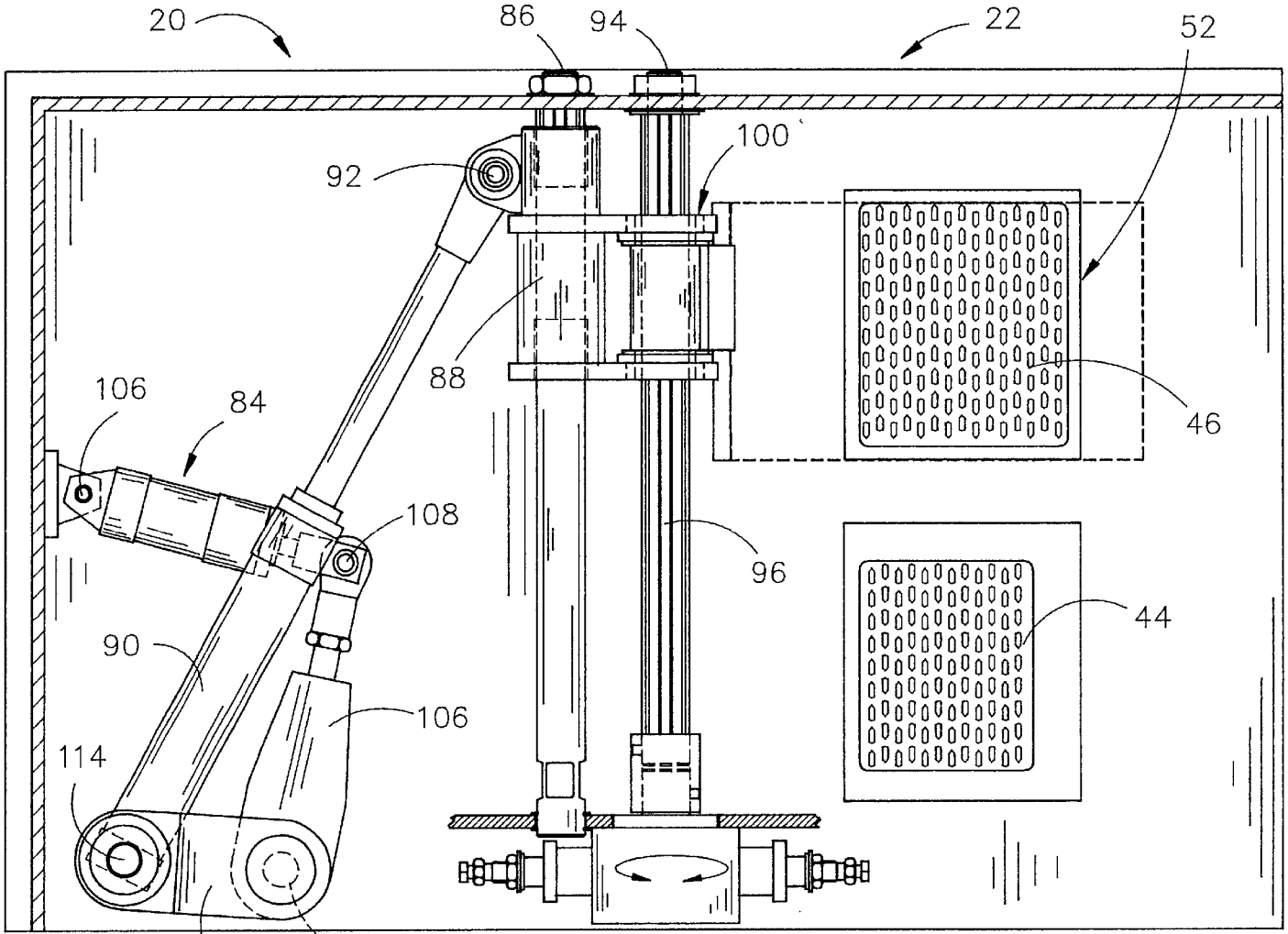
FIG. 6 is a view similar to FIG. 5 except that the magnetic shuttle plate is shown in a position adjacent the other plate hopper on the end frame.

A power cylinder 104 such as a hydraulic cylinder or an air cylinder is pivotally connected at one end to the end frame 20 at 106. The rod end of the cylinder 104 is pivotally connected to a manually length adjustable link 106 at 108, as seen in FIG. 5. The lower end of link 106 is fixed to a shaft 110 which has an arm 112 secured thereto for rotation therewith. The outer end of arm 112 is pivotally connected to the cylinder 90 at 114. When cylinder 90 is extended, the support 88 longitudinally moves on the shaft 86 from the position of FIG. 5 to the position of FIG. 6. When the support 88 is in the position of FIG. 5, the shuttle plate 100 is positioned adjacent hopper 50. When the support 88 is in the position of FIG. 6, the shuttle plate 100 is positioned adjacent hopper 52. When the shuttle plate portion 102 is in its horizontally disposed position, the shuttle plate 102 will be positioned beneath hopper 50 when cylinder 90 is retracted and shuttle plate portion 102 will be beneath hopper 52 when cylinder 90 is extended. When the magnetic plate portion 102 is in its vertically disposed position, as seen in FIG. 2, extension of the cylinder 84 causes the support 88 to be moved slightly on the shaft 86, since the arm 112 will cause cylinder 90 to move slightly, thereby also moving the support 88 slightly. The purpose of such movement will be described in detail hereinafter.

Figure 8:
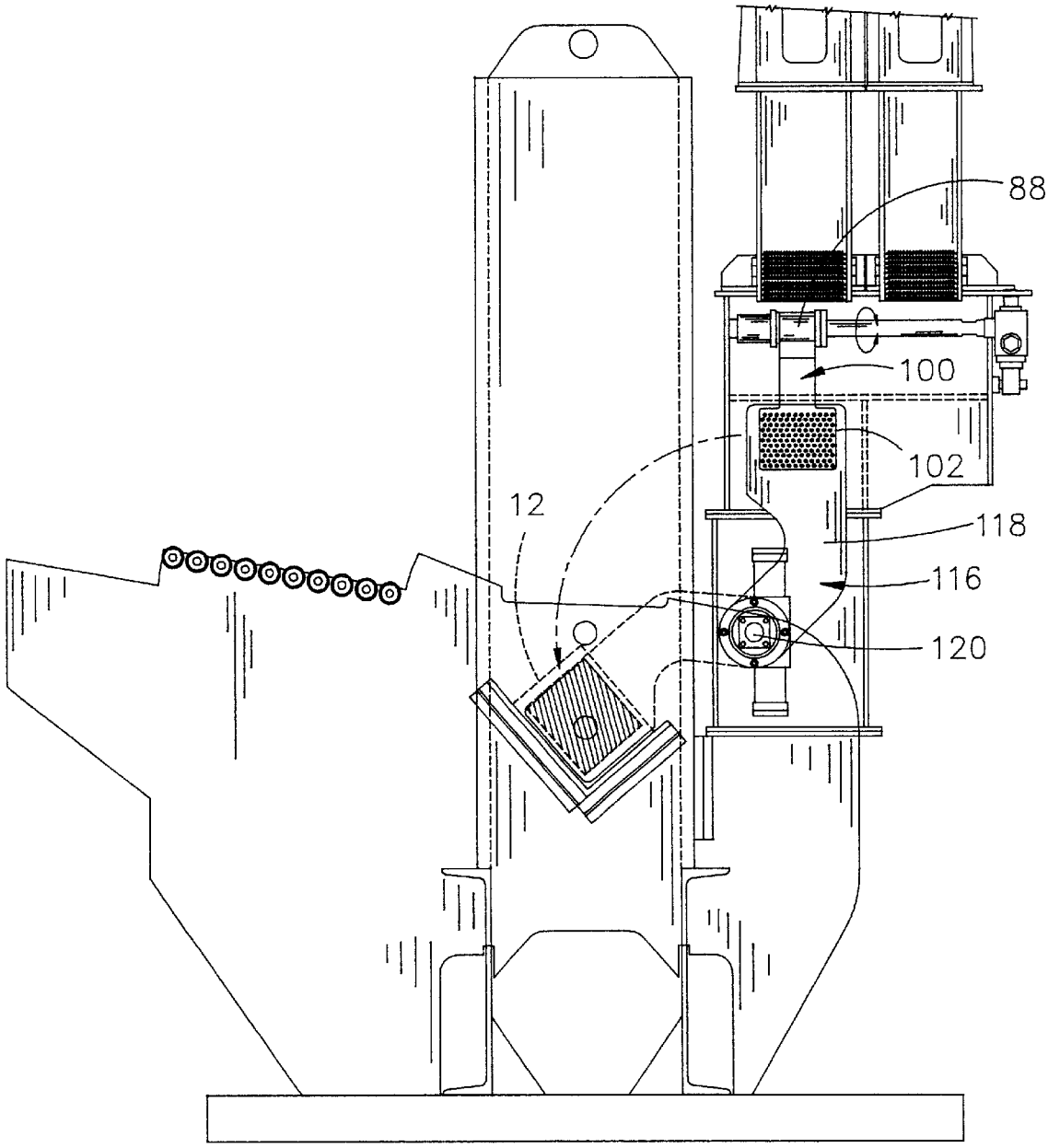
FIG. 8 is a partial vertical sectional view illustrating the associated transporter arm positioned adjacent the vertically disposed shuttle plate and which illustrates the transporter arm having been moved to its lower position so that the end plate is positioned adjacent the end of the tie.
Figure 9:
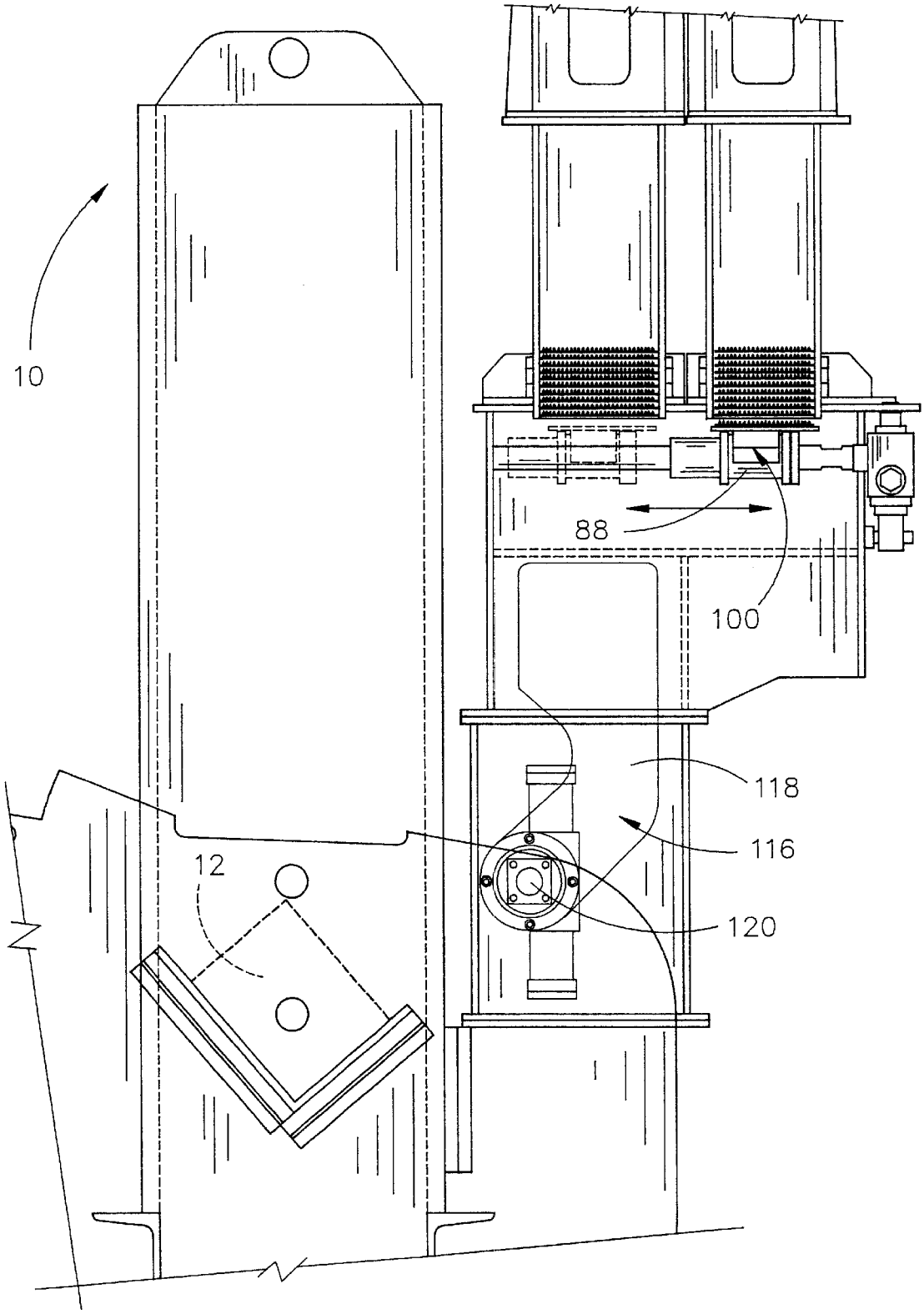
FIG. 9 is a partial vertical sectional view illustrating the manner in which the magnetic shuttle plate may be moved with respect to the two end plate hoppers on the end frame.
Figure 10B:
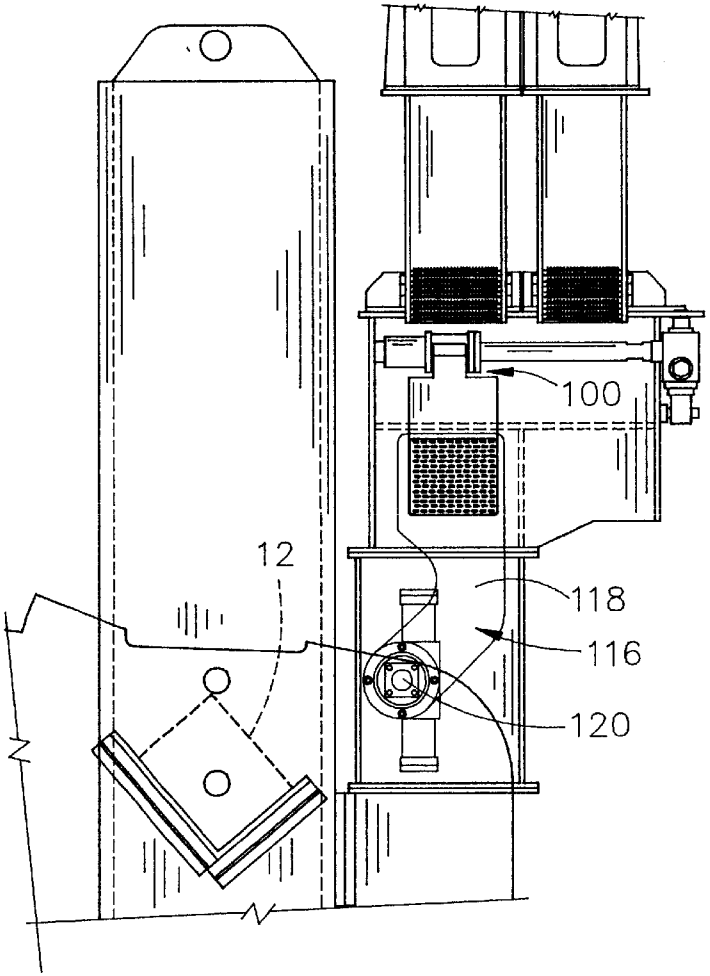
FIG. 10B is a view similar to FIG. 10A except that the shuttle plate having an end plate thereon has been pivotally moved downwardly into a vertically disposed position adjacent the transporter arm.
Figure 10A:
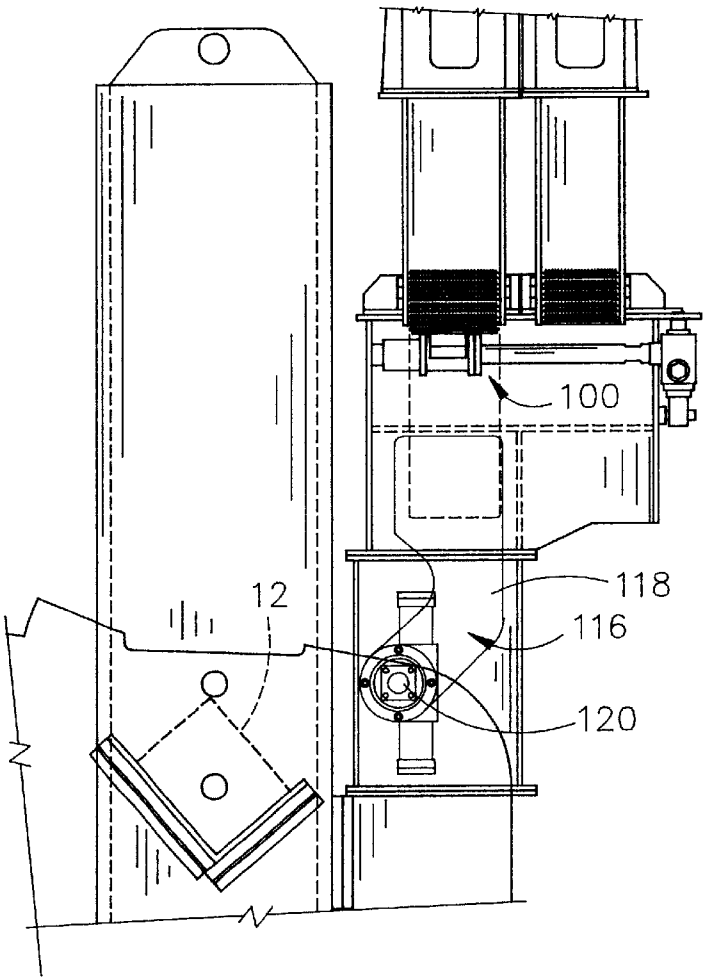
FIG. 10A is a partial sectional view similar to FIG. 9 but which shows the shuttle plate having been moved to a position beneath the other hopper on the end frame.
Figure 11B:
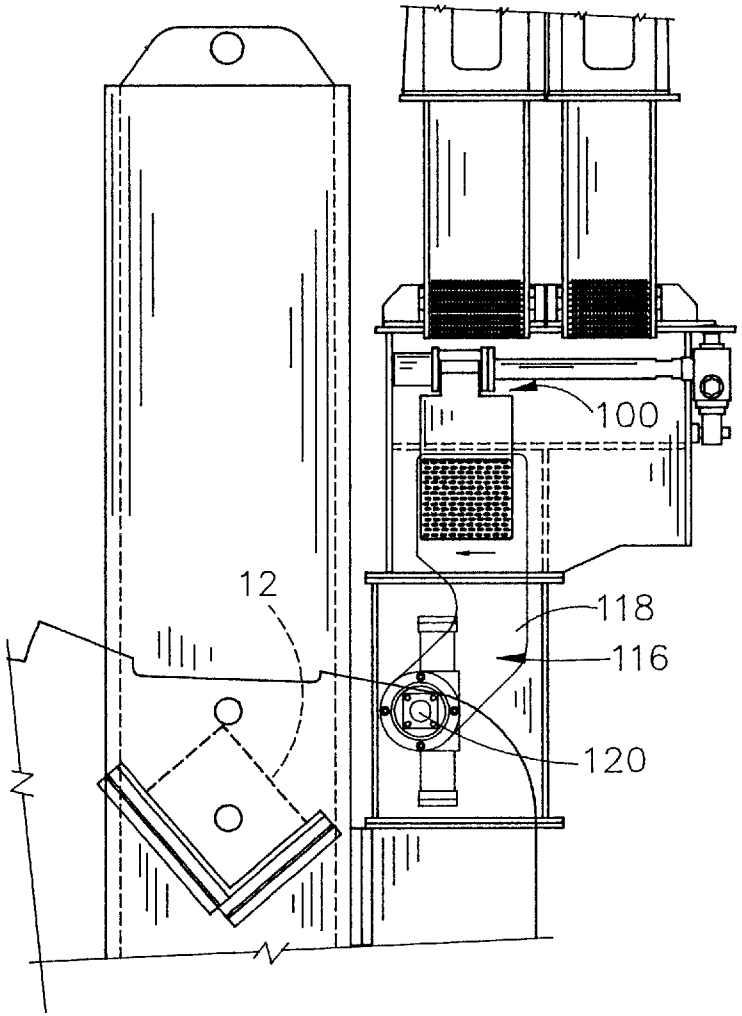
FIG. 11B is a view similar to FIG. 11A except that the shuttle plate has been moved to the left with respect to the transporter arm of FIG. 11*a*.
Figure 11A:
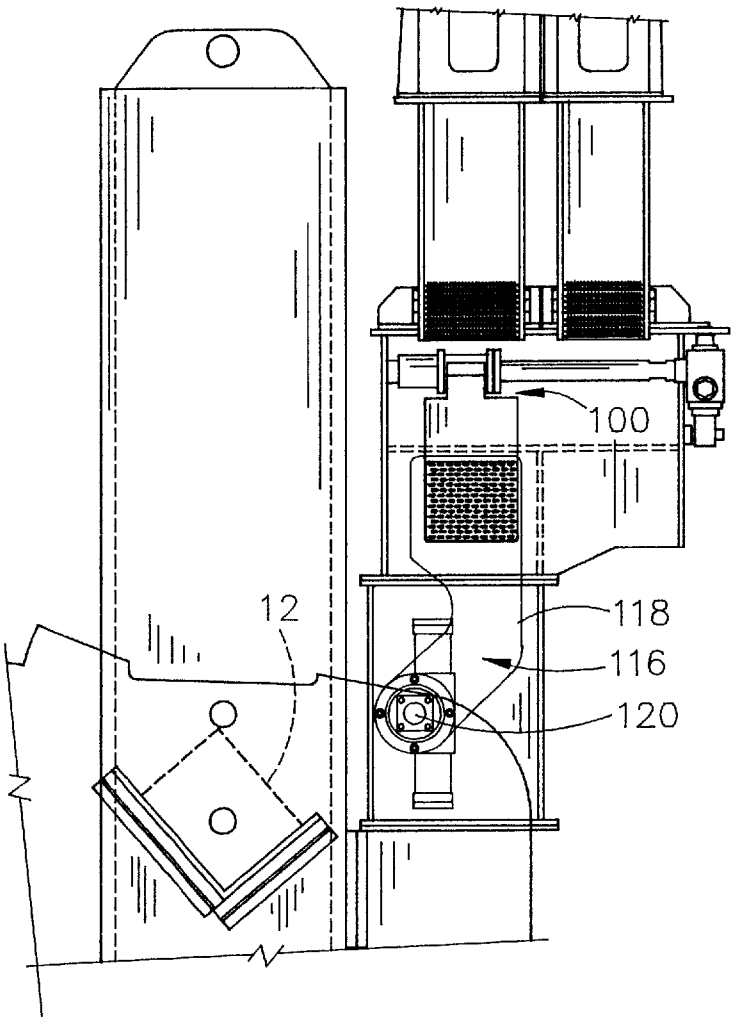
FIG. 11A is a view identical to FIG. 10B.

The numeral 116 refers to a plate transporter assembly which is movably mounted in end frame 20. A plate transporter assembly is also mounted on end frame 22. The plate transporter assemblies 116 are identical to that described in U.S. Pat. No. 5,927,586. Plate transporter assembly 116 includes a transporter arm 118 mounted on the end of a selectively rotatable shaft 120. The plate transporter arm 118 may be rotatably moved from the position shown in solid lines in FIG. 8 to the lowered position also shown in FIG. 8. When the arm 118 is in the upper position illustrated in FIG. 8, the upper end thereof will be normally positioned slightly inwardly of the magnetic plate portion 102 having the end plate magnetically secured thereto, as illustrated by broken lines in FIG. 4. The outer end of arm 118 has a plurality of openings formed therein which are adapted to receive the teeth 48 of the plate, as will be described hereinafter. The shaft 120 is horizontally movable so that the transporter arm 118 can be moved to the left from the dotted line position of FIG. 4 towards the magnetic plate portion 102 so that the teeth of the end plate are received in the openings in the transporter arm 118 to attach the end plate to the arm 118. When the arm 118 is in its lower position, the shaft 120 is again horizontally movable to permit the end plate to be transferred from the arm 118 to the power ram, as described in U.S. Pat. No. 5,927,586.

Prior to the beginning of the end plating operation, the various components of the machine are in the position illustrated in FIG. 1. A tie 12 is delivered to the in-feed conveyor 28 and is delivered to the plating machine following the end plating of a preceding tie 12. The tie moves forward on the in-feed conveyor 28 until tie 12 engages switch 130 and comes to rest against stop 132. A tie sensing arm (not shown) similar to the tie sensing arm 34 in U.S. Pat. No. 5,927,586 is then pivotally moved until it engages the rearward side of the tie 12. The tie sensing arm senses the dimension of the tie being end plated and that can be any one of three dimensions. For purposes of description, the numeral 12A will refer to the smallest tie to be end plated while the numeral 12B will identify a tie having a dimension between the tie of 12A and the 12C tie. The end plates 44 are driven into the ends of the tie 12A. The end plates 46 are driven into the ends of the ties 12B or 12C, with the end plates 46 being centered between the leading and trailing edges of the ties 12B and 12C.

The end plating machine, after sensing whether a tie 12A, 12B or 12C has been delivered to the end plating machine, will position the tie between the tie clamping assemblies 30 and 32. The tie clamping apparatus 30 and the clamping apparatus 32 will squeeze or clamp the ends of the tie to close any splits or cracks therein. Inasmuch as the end plating operation at each end of the tie is identical, only the end plating operation at one end of the tie will be described in detail. Assuming that a smaller tie 12A has been sensed, the power cylinder 90 is retracted so that the shuttle plate 100 is positioned in the position illustrated in FIG. 5 with respect to the hopper or station 50. If the magnetic shuttle plate portion 102 is not in its horizontally disposed position, the rotary actuator 98 will be activated to rotate shaft 94 so that the magnetic shuttle plate 102 is positioned beneath the hopper closure assembly 60 and the fingers 80 and 82 thereof which are maintaining the end plates 44 in the hopper 50 at this time. The hopper closure assembly 60 is then opened by pivoting the arms 64 and 66 outwardly with respect to one another so that the lowermost plate 44 in hopper 50 drops onto the horizontally disposed magnetic shuttle plate portion 102. The hopper closure assembly 60 is then operated to pivot the arms 64 and 66 towards one another which causes the fingers 80 and 82 to move between the end plate supported on the magnetic shuttle plate portion 102 and the end plate immediately thereabove, thereby separating the end plate on the magnetic shuttle plate portion 102 from the other end plates 44 in the hopper 50.

The rotary actuator 98 is then operated to cause the shuttle plate portion 102 to pivotally move from its horizontally disposed position to its vertically disposed position. Cylinder 90 is then extended to cause the support 88 and the shuttle plate 100 to move horizontally to a position adjacent the opposite end of the sleeve 96. At that time, the end plate 44 will be properly aligned with the transporter arm 118 which will be in the dotted line position of FIG. 4. The shaft 120 of plate transporter assembly 116 is then moved towards the left, as viewed in FIG. 4, so that the teeth 48 of the end plate 44 will pass into the openings in the outer end of arm 118. The reception of the teeth 48 in the openings formed in the outer end of arm 118 causes the end plate 44 to be firmly grasped by the plate transporter arm 118. At that time, the transporter arm 118 will be lowered by shaft 120 so that the end of the transporter arm 118 is positioned adjacent the magnetic portion 42 of the power ram 40. When the end plate 44 has been magnetically adhered to the magnetic head 42, the shaft 120 is moved to the right so that the plate transporter arm 118 separates from the plate 44 with the plate 44 remaining on the power ram. The plate transporter arm 118 is then pivotally moved out of the way of the power ram and the power ram is extended to drive the end plate 44 into the end of the tie.

Figure 7:
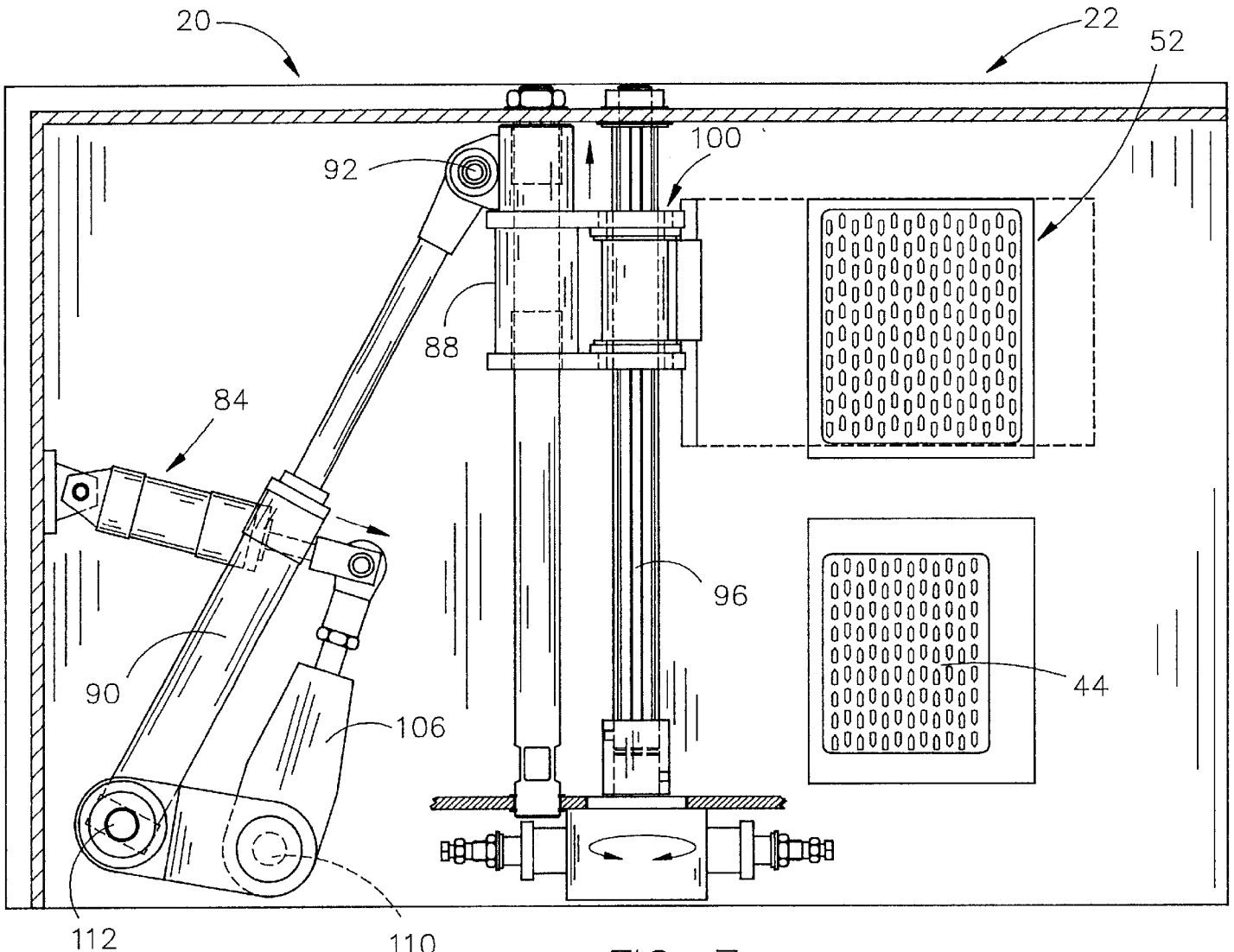
FIG. 7 is a view similar to FIG. 6 but which illustrates the shuttle plate having been moved incrementally horizontally.
Figure 12:
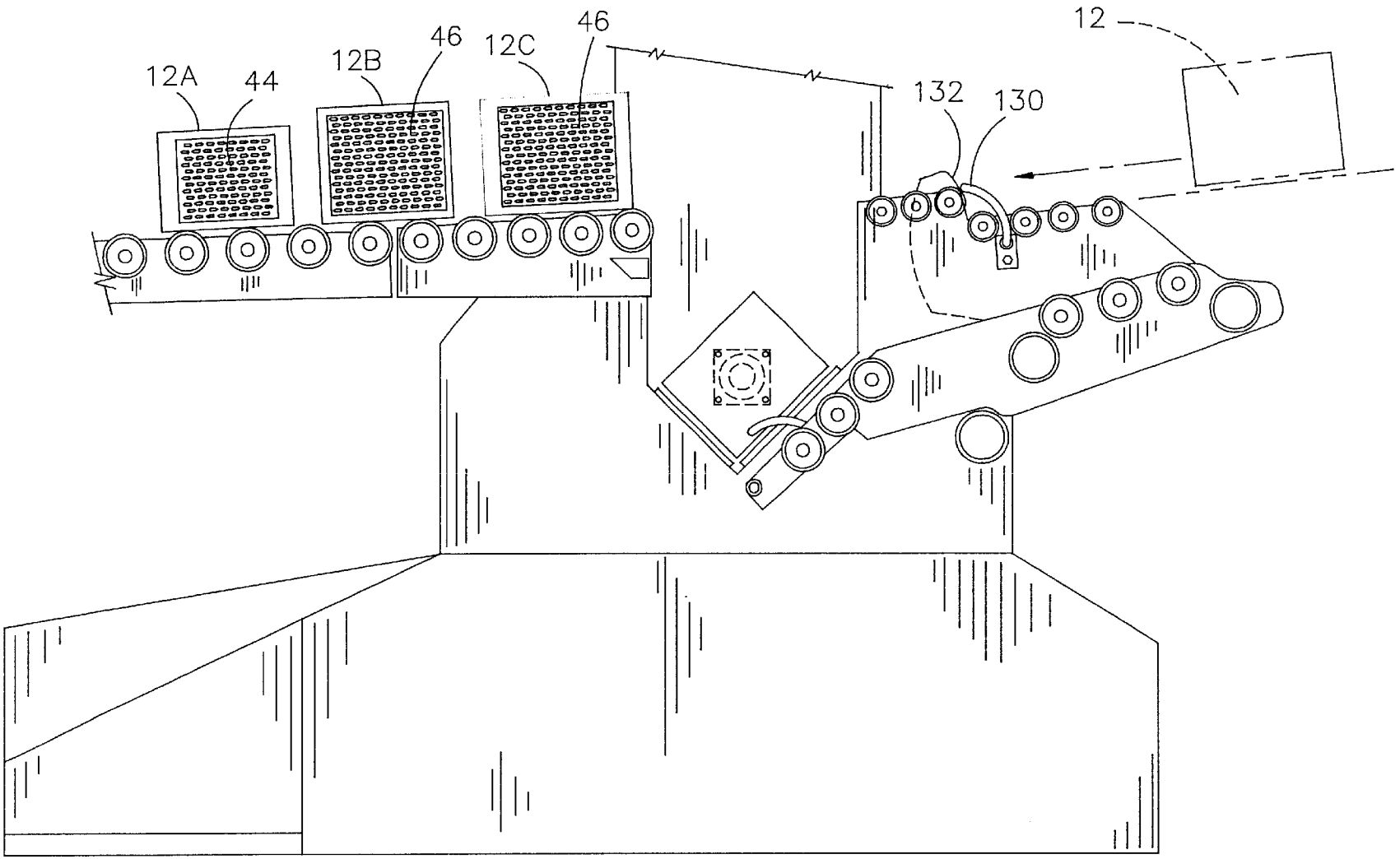
FIG. 12 is a partial sectional view illustrating the tie eject means.

If a tie having the dimension of tie 12B is sensed, the same end plate 46 will be utilized as on the tie 12C. However, the use of the end plate 46 on the tie 12B requires some adjustment of the end plate on the shuttle plate portion 102 so that the end plate 46 will be properly positioned with respect to the end of the tie 12B. Once the plate 46 has been magnetically adhered to the shuttle plate portion 102 and the shuttle plate portion 102 has been pivoted to its vertically disposed position, the cylinder 104 is slightly automatically extended so that the link 106 is rotated in a clockwise direction, as illustrated in FIG. 7, which causes the support 88 and the shuttle plate 100 to be incrementally moved in the direction of the arrow on sleeve 96. The slight horizontal movement of the vertically disposed shuttle plate portion 102 and the end plate 46 thereon changes the position of the end plate 46 with respect to the plate transporter arm 118. Thus, when the transporter arm 118 delivers the end plate 46 to the power ram for use on a 12B tie, the end plate 46 will be positioned slightly differently on the power ram so that the end plate 46 will be driven into the end of the tie 12B in such a manner so that the end plate 46 will be centered thereon, as illustrated in FIG. 12.

Although it is preferred that two plate hoppers be positioned on each of the end frames, the machine will also function with only a single plate hopper on each end frame. However, in such a construction, the machine would not have the ability to end plate three different sizes of ties with two different sizes of end plates.

Thus it can be seen that applicant has provided an improved end plating machine over that previously described in his earlier patents in that fewer components are required, the operation is more precise and permits the use of three different dimensioned ties to be end plated with only two different dimensioned end plates with the end plates being centered in the ends of the various dimensioned ties.

Thus, it can been seen that the invention accomplishes at least all of its stated objectives.

I claim:

1. An end plating machine for a wood tie having opposite ends, comprising:

a frame means including horizontally spaced-apart first and second end frames;

said frame means having tie in-feed and out-feed portions;

said first and second end frames adapted to receive a tie therebetween;

a first tie clamping means adjacent said first end frame for clamping one end of a tie positioned between said end frames;

a second tie clamping means adjacent said second end frame for clamping the other end of the tie positioned between said end frames;

a first horizontally disposed, power ram means associated with said first end frame for driving an end plate into one end of the tie while said first tie clamping means is clamping the one end of the tie positioned therein;

a second horizontally disposed, power ram means associated with said second end frame for driving an end plate into the other end of the tie while said second tie clamping means is clamping the other end of the tie positioned therein;

a first end plate hopper on said first end frame for supporting a first group of vertically stacked end plates;

a second end plate hopper on said first end frame for supporting a second group of vertically stacked end plates;

a third end plate hopper on said second end frame for supporting a third group of vertically stacked plates;

a fourth end plate hopper on said second end frame for supporting a fourth group of vertically stacked end plates;

the first and third groups of end plates having the same dimension;

the second and fourth groups of end plates having the same dimension;

said first and third groups of end plates having a different dimension than said second and fourth groups of end plates;

a first shuttle plate assembly associated with said first end frame;

a second shuttle plate assembly associated with said second end frame;

said first shuttle plate assembly including a horizontally movable magnetic shuttle plate which is selectively horizontally movable beneath said first and second end plate hoppers for selectively receiving the lowermost end plate from either said first or second end plate hoppers;

said second shuttle plate assembly including a horizontally movable magnetic shuttle plate which is selectively horizontally movable beneath said third and fourth end plate stations for selectively receiving the lowermost end plate from either said third or fourth end plate stations;

each of said magnetic shuttle plates adapted to magnetically support an end plate thereon;

each of said magnetic shuttle plates of said first and second shuttle plate assemblies being selectively movable from a horizontally disposed position to a vertically disposed condition;

a first end plate transporter movably mounted on said first end frame for successively transporting individual end plates from said magnetic shuttle plate of said first shuttle plate assembly, when said magnetic shuttle plate is in its vertically disposed position, to a position adjacent first power ram means so that said first power ram means may drive the end plate into one end of the tie positioned in said tie clamping means;

a second end plate transporter movably mounted on said second end frame for successively transporting individual end plates from said magnetic shuttle plate of said second shuttle plate assembly, when said magnetic shuttle plate is in its vertically disposed position, to a position adjacent the other end of said second power ram means so that said second power ram means may drive the end plate into the other end of the tie positioned in said second tie clamping means.

2. The end plating machine of claim 1 wherein said magnetic shuttle plates of said shuttle plate assemblies are selectively horizontally movable when in their vertically disposed positions to move the end plate thereon relative to the associated end plate transporter.

3. The end plating machine of claim 1 wherein each of said first and second shuttle plate assemblies comprises:

(a) an elongated first horizontally disposed, fixed shaft mounted on the associated end frame;

(b) a first support longitudinally movably mounted on said first shaft;

(c) an elongated second horizontally disposed shaft rotatably mounted on the associated end frame;

(d) said first support rotatably and longitudinally movably receiving said second shaft;

(e) said magnetic shuttle plate being fixed to said second shaft whereby longitudinal movement of said first support with respect to said first and second shafts will cause horizontal movement of said magnetic shuttle plate with respect to the associated end plate stations on the associated end frame;

(f) first power means connected to said second shaft for rotating said second shaft to move said magnetic shuttle plate between its horizontally disposed position to its vertically disposed position;

(g) and a second power means connected to said support for longitudinally moving said support with respect to said first shaft when said magnetic shuttle plate is in its horizontally disposed position.

4. The end plating machine of claim 3 further including a third power means operatively connected to said support for horizontally moving said support and said magnetic shuttle plate when said magnetic shuttle plate is in its said vertically disposed position.

5. The end plating machine of claim 4 wherein said third power means comprises a power cylinder.

6. The end plating machine of claim 3 further including a third power means which is operatively connected to said second power means for horizontally moving said support and said magnetic shuttle plate when said magnetic shuttle plate is in its said vertically disposed position.

7. The end plating machine of claim 6 wherein each of said second and third power means comprises a power cylinder.

8. The end plating machine of claim 3 wherein said second power means comprises a power cylinder.

9. An end plating machine for a wood tie having opposite ends, comprising:

a frame means including horizontally spaced-apart first and second end frames;

said frame means having tie in-feed and out-feed portions;

said first and second end frames adapted to receive a tie therebetween;

a first tie clamping means adjacent said first end frame for clamping one end of a tie positioned between said end frames;

a second tie clamping means adjacent said second end frame for clamping the other end of the tie positioned between said end frames;

a first horizontally disposed, power ram means associated with said first end frame for driving an end plate into one end of the tie while said first tie clamping means is clamping the one end of the tie positioned therein;

a second horizontally disposed, power ram means associated with said second end frame for driving an end plate into the other end of the tie while said second tie clamping means is clamping the other end of the tie positioned therein;

a first end plate hopper on said first end frame for supporting a plurality of vertically stacked end plates;

a second end plate hopper on said second end frame for supporting a plurality of vertically stacked end plates;

a first shuttle plate assembly associated with said first end frame;

a second shuttle plate assembly associated with said second end frame;

said first shuttle plate assembly including a magnetic shuttle plate which is positioned beneath said first end plate station for selectively receiving the lowermost end plate in said first end plate hopper;

said second shuttle plate assembly including a magnetic shuttle plate which is positioned beneath said second end plate station for selectively receiving the lowermost end plate from said second end plate hopper;

each of said magnetic shuttle plates adapted to magnetically support an end plate thereon;

each of said magnetic shuttle plates of said first and second shuttle plate assemblies being selectively movable from a horizontally disposed position to a vertically disposed condition;

a first end plate transporter movably mounted on said first end frame for successively transporting individual end plates from said magnetic shuttle plate of said first shuttle plate assembly, when said magnetic shuttle plate is in its vertically disposed position, to a position adjacent said first power ram means so that said first power ram means may drive the end plate into one end of the tie positioned in said first tie clamping means;

a second end plate transporter movably mounted on said second end frame for successively transporting individual end plates from said magnetic shuttle plate of said second shuttle plate assembly, when said magnetic shuttle plate is in its vertically disposed position, to a position adjacent said second power ram means so that said second power ram means may drive the end plate into the other end of the tie positioned in said second tie clamping means.

10. The end plating machine of claim 9 wherein said magnetic shuttle plates of said shuttle plate assemblies are selectively horizontally movable when in their vertically disposed positions to move the end plate thereon relative to the associated end plate transporter.

11. The end plating machine of claim 9 wherein each of said first and second shuttle plate assemblies comprises:

(a) an elongated first horizontally disposed, fixed shaft mounted on the associated end frame;

(b) a first support longitudinally movably mounted on said first shaft;

(c) an elongated second horizontally disposed shaft rotatably mounted on the associated end frame;

(d) said first support rotatably and longitudinally movably receiving said second shaft;

(e) said magnetic shuttle plate being fixed to said second shaft whereby longitudinal movement of said first support with respect to said first and second shafts will cause horizontal movement of said magnetic shuttle plate with respect to the associated end plate station on the associated end frame;

(f) first power means connected to said second shaft for rotating said second shaft to move said magnetic shuttle plate between its horizontally disposed position to its vertically disposed position;

(g) and a second power means connected to said support for longitudinally moving said support with respect to said first shaft when said magnetic shuttle plate is in its horizontally disposed position.

12. The end plating machine of claim 11 further including a third power means operatively connected to said support for horizontally moving said support and said magnetic shuttle plate when said magnetic shuttle plate is in its said vertically disposed position.

13. The end plating machine of claim 12 wherein said third power means comprises a power cylinder.

14. The end plating machine of claim 11 further including a third power means which is operatively connected to said second power means for horizontally moving said support and said magnetic shuttle plate when said magnetic shuttle plate is in its said vertically disposed position.

15. The end plating machine of claim 14 wherein each of said second and third power means comprises a power cylinder.

16. The end plating machine of claim 11 wherein said second power means comprises a power cylinder.

* * * * *